United States Patent [19]

Gill et al.

[11] Patent Number: 4,951,748

[45] Date of Patent: Aug. 28, 1990

[54] TECHNIQUE FOR ELECTRICALLY HEATING FORMATIONS

[76] Inventors: William G. Gill, 245 Circle Dr., Corpus Christi, Tex. 78411; Hugh Gill, 522 McClendon, Corpus Christi, Tex. 78404

[21] Appl. No.: 303,455

[22] Filed: Jan. 30, 1989

[51] Int. Cl.[5] ..... E21B 43/24; E21B 47/06; E21B 49/00

[52] U.S. Cl. ..... 166/248; 166/60; 166/65.1; 166/250; 166/302; 73/151

[58] Field of Search ..... 166/60, 65.1, 250, 248, 166/302; 73/151

[56] References Cited

U.S. PATENT DOCUMENTS

| | | | |
|---|---|---|---|
| 3,507,330 | 4/1970 | Gill | 166/248 |
| 3,547,193 | 12/1970 | Gill | 166/248 |
| 3,605,888 | 9/1971 | Crowson | 166/248 |
| 3,614,986 | 10/1971 | Gill | 166/248 |
| 3,620,300 | 11/1971 | Crowson | 166/248 |
| 3,642,066 | 2/1972 | Gill | 166/248 |
| 3,989,107 | 11/1976 | Fisher et al. | 166/248 |
| 4,010,799 | 3/1977 | Kern et al. | 166/248 |
| 4,135,579 | 1/1979 | Rowland | 166/248 |
| 4,140,179 | 2/1979 | Kasevich | 166/248 |
| 4,140,180 | 2/1979 | Bridges et al. | 166/248 |
| 4,144,935 | 3/1979 | Bridges | 166/248 |
| 4,193,451 | 3/1980 | Dauphine | 166/248 |
| 4,320,801 | 3/1982 | Rowland | 166/248 |
| 4,396,062 | 8/1983 | Iskander | 166/248 |
| 4,444,255 | 4/1984 | Geoffrey et al. | 166/248 |
| 4,449,585 | 5/1984 | Bridges et al. | 166/248 |
| 4,524,827 | 6/1985 | Bridges et al. | 166/248 |
| 4,545,435 | 10/1985 | Bridges et al. | 166/248 |
| 4,583,589 | 4/1986 | Kasevich | 166/248 X |

*Primary Examiner*—George A. Suchfield
*Attorney, Agent, or Firm*—G. Turner Moller

[57] ABSTRACT

A technique of heating a subterranean oil bearing formation comprises determining a thermal harmonic frequency of the formation and applying a form of alternating current to the formation that includes the thermal harmonic frequency to increase the temperature of the formation. Heated oil is produced from the formation. A standard three phase ac power source is converted to dc and then chopped to single phase ac so substantially all of the purchased power can be delivered to the well.

11 Claims, 2 Drawing Sheets

TECHNIQUE FOR ELECTRICALLY HEATING FORMATIONS

This invention relates to a technique for electrically heating subterranean formations, particularly those bearing liquid hydrocarbons.

There are many oil producing regions in the world where liquid hydrocarbons in the ground do not flow at a desired rate because the viscosity is too high at formation temperature. Often, these liquid hydrocarbons are in association with saline formation water and the relative viscosity of the oil is much too high relative to the water. In these situations, heating of the formation and consequently heating of the oil and water causes viscosity reductions in both, but primarily in the oil. Because the viscosities of typical crude oils are much more temperature dependent than the viscosity of typical saline waters, a modest increase in formation temperature often creates a much more favorable viscosity ratio. For instance, a 10° Farenheit increase in the temperature of most oils will cut the viscosity in half, which in turn will double the oil flow rate through the heated section. Often this change in viscosity ratio is sufficient to cause the production of much more oil and change an uneconomic situation into a profitable one. This situation is common in heavy crude producing areas of the world where produced crudes show API gravities of 18° or less.

A number of different heating techniques have been attempted in such areas where the producing formations are relatively thick. These techniques include steam injection, in-situ combustion, hot water floods and electrical heating. Where the formations are relatively thin, no heating technique is very successful because of excessive heat loss to the overlying and underlying formations. If the criteria of success of heating techniques is the frequency with which they are used, the only substantially successful technique is steam injection because it has been used in more producing fields to produce more incremental oil than all other heating techniques combined.

The reason heating techniques are unsuccessful is that more money has to be spent, in the form of equipment, manpower and energy, than is justified by increased oil production. In all heating techniques, a substantial improvement in thermal efficiency, i.e. the ratio of formation and oil heated to energy expended, would dramatically change the efficiency of the process and thereby dramatically affect the economic viability of any formation heating project.

Electrically heating oil bearing formations is old and well known in the art. Developments in which the present inventors had a significant part are found in U.S. Pat. Nos. 3,507,330, 3,547,193, 3,605,888, and 3,642,066. This approach includes delivering an alternating current into the well and transmitting it through saline connate water in the oil bearing formation. Resistive heating occurs in the saline water. When the water heats up, heat is transmitted to the adjacent oil. Disclosures relevant to this invention are found in U.S. Pat. Nos. 4,010,799; 4,135,579; 4,140,179; 4,140,180; 4,193,451 and 4,320,801.

Another situation where it is desirable to heat oil producing formations is where the crude oil has unusual pour point characteristics. For example, in much of the Uinta Basin of eastern Utah, crude oil from two quite distinct formations suffer the same unusual property of flowing easily like conventional crude oils at 120° F. but look like shoe polish at 75° F. room temperature. This phenomenon is well known and is caused by a high wax content in the crude oil. This high wax content requires that flow lines, gun barrels, tanks, tank trucks and the like be heated. Unfortunately, the reduction in flowing temperature often occurs before the produced oil reaches the surface thereby plugging production tubing well below the depth where conventional heating techniques can be used.

This sounds like the old and well known oil field problem where paraffin from paraffin based crude oils often settles out of crude oil inside the tubing strings where the flowing temperature falls below some predetermined temperature, often opposite some relatively shallow fresh water aquifer. Oil producing companies are well acquainted with paraffin problems and have devised many different techniques for dealing with it. The problem of high pour point crudes is quite different and, for present purposes, it will suffice to say that these techniques have not been successful in maintaining production of Uinta Basin wells to anything like their potential.

If there is any free gas in the formation of a high pour point crude, such as that of the Uinta Basin, it is conceivable that the expanding gas can cause local cooling of the formation adjacent the well bore where velocities are fastest and the greatest pressure drop occurs. This, of course, is catastrophic because production dwindles off and stops. Tripping the tubing and cleaning it out may seem to cure the problem because production begins again, only to dwindle off and stop again. To begin with, these problems are difficult to diagnose because one normally tries those solutions that have always worked to a well which has stopping producing—you see if the pump is working, the tubing is plugged up or the perforations are plugged up. In addition, very little can be easily done where the problem occurs in the formation.

Electrical heating of Uinta Basin type formations is very desirable for a variety of reasons. First, not much heating is required—only enough to keep the material liquid—which may not be more than an additional 30° F. Second, it is easy to control electric heating because the amount of energy delivered into the ground can be closely monitored and changed. This means that excessive heating can be avoided thereby minimizing energy costs, electricity having to be purchased, usually directly from a utility or indirectly by the consumption of capital and fuel. Even in these situations where electrical heating appears to be very desirable, thermal efficiency remains paramount because an inefficient operation will shortly be driven from the market. Thus, an improvement in thermal efficiency would dramatically improve the economics of Uinta Basin type or other high pour point oil production.

During the conduct of laboratory experiments involving electrically heating oil bearing formations, an unusual effect has been noted. As shown in FIG. 1, a test cell 10 comprises a closed container 12 having a quantity of rock 14 representing an oil productive formation containing a liquid representative of the hydrocarbon-water mixture in the ground. The rock 14 is preferably obtained by grinding up cores from the productive formation. The liquid in the formation 14 is mixed from produced oil, gas and water to create a liquid as representative as possible of formation liquid. A pair of electrical conductors 16, 18 represent wells through which electricity is delivered to the formation 14. A test probe 20 between the conductors 16, 18 comprises a thermocouple 22 for measuring the temperature of the formation 14 and a pressure transducer 24 for measuring the pressure of the liquid in the formation 14. In such tests, electrical energy is delivered to the formation 14 through the conductors 16, 18 at a predetermined amperage, voltage and frequency. Referring to FIG. 2, a normal test uses commercially available 110 v, 60 Hz alternating current. A normal time-temperature response curve 26 starts at an initial point 28 at ambient temperature and gradually increases in a more-or-less linear fashion through a region 30 until temperature losses through the container 12 causes the temperature rise to slow down until equilibrium is ultimately reached in a region 32.

Many hundreds of such tests have been run. Once in a while, the response curve produced an anomalous result shown by the curve 34 where the temperature gradually increases from an initial point 36 at ambient temperature in a more-or-less linear fashion through a region 38 until an abrupt change in slope occurred in a region 40 and temperature at the thermocouple 22 increased abruptly. Typically, the region 40 is of relatively short duration. The recorded temperature continued to increase, but in a region 42 roughly parallel to the upper end of the region 30. Ultimately, thermal equilibrium was reached in a region 44.

It is now believed there are at least two heating mechanisms operating in the test cell 10. Heating in the regions 38 and 42 are the normal type of heating seen when heating any material, i.e. ohmic or resistive heating. Heat and consequently temperature are, of course, a manifestation of molecular motion. What happens in the region 40 is that the applied electric current is at a frequency which is some harmonic of a significant component of the formation rock molecules or of the formation liquid molecules. This increase in the temperature in the region 40 can be used to dramatically increase the effectiveness of formation heating because the necessary temperature rise can be achieved with an expenditure of far less energy. This increase in thermal efficiency has a dramatic effect on the economics of any heating project.

One might properly ask why increased temperature rise in the region 40 may be a function of a match between the frequency of the applied alternating current and some harmonic of the formation or liquid therein because, after all, the frequency applied during the test was constant 60 Hz alternating current. It is believed the harmonic response is a function of the formation composition, the formation liquid and gas composition, the formation temperature and the formation pressure. As presently advised, formation pressure is believed to be significantly important only when free gas is present in the formation and an increase in pressure acts to drive the free gas back into solution and thus change the composition of the formation liquid. An increase in temperature causes gas to break out of solution. The exact effect of increasing temperature and pressure in the reservoir will depend on the composition of the formation fluid and perhaps the composition of the formation. The harmonic response in the region 40 is temperature dependent in the sense that when the temperature of the formation rises, the applied current frequency that creates the harmonic response rises. Thus, in the abnormal tests exemplified by the curve 34, the temperature of the formation rose enough that the harmonic frequency rose to a value of 60 Hz. After the formation temperature had driven the harmonic frequency to a value above 60 Hz, harmonic heating in the region 40 ceased and normal ohmic heating was again the dominant heating mechanism operating. In a sense, the normal curve 26 fails to show the harmonic response because the original formation temperature was too high or the test cell 10 did not get hot enough to reach the harmonic response.

In accordance with this invention, field operations are conducted to heat a subterranean oil bearing formation with a form of alternating current at a selected frequency which corresponds to the frequency eliciting harmonic heating of the formation. Initially, scale model tests are conducted in the test cell 10 to determine an approximate value for the harmonic frequency at the existing formation temperature. Wells are then equipped with suitable insulators to deliver electricity into the formation. The frequency of current delivered into the wells is changed from conventional 60 Hz AC into the desired wave shape and frequency desired and delivered down the wells. After heating starts, the frequency may be varied in a range including the laboratory determined harmonic frequency in an attempt to insure that at least some of the electrical energy delivered into the formation is at the actual harmonic frequency of the formation which elicits harmonic heating as evidenced in the region 40. In elaborate installations, a temperature sensor is placed near the bottom of the well to deliver a readout at the surface on a more-or-less continuous basis. Thus the applied frequency and temperature rise can be monitored on a continuous basis. Not only can one thus be sure that harmonic heating occurs, but one can also change the applied frequency to fine tune the operation.

Oil is produced from the wells and its temperature is measured and recorded. When the temperature of the oil rises above that believed to be due solely to resistive heating, a manifestation of harmonic heating is seen, either at the surface or from the bottom hole sensor. As heating continues and the formation temperature increases, the frequency eliciting the harmonic heating effect increases. Accordingly, the frequencies applied to the well is increased, i.e. the range is moved slightly up the scale.

It is accordingly an object of this invention to provide a new and improved technique for heating a subterranean oil bearing formation.

Another object of this invention is to provide an improved electrical heating technique exhibiting improved thermal efficiency.

These and other objects of this invention will become more fully apparent as this description proceeds, reference being made to the accompanying drawings and appended claims.

BRIEF DESCRIPTION OF THE DRAWINGS

Referring to FIG. 3, there is illustrated a well 46 equipped to deliver alternating current into the formation at a frequency corresponding to a thermal harmonic frequency of the formation or the formation contents. The well 46 illustrates a typical open hole completion in which a bore hole 48 extends downwardly from the surface toward an oil bearing formation 50. A casing string 52 has been cemented in the bore hole 48 above or in the top of the formation 50 and the bore hole 48 deepened into or through the formation 50.

Figure 1:
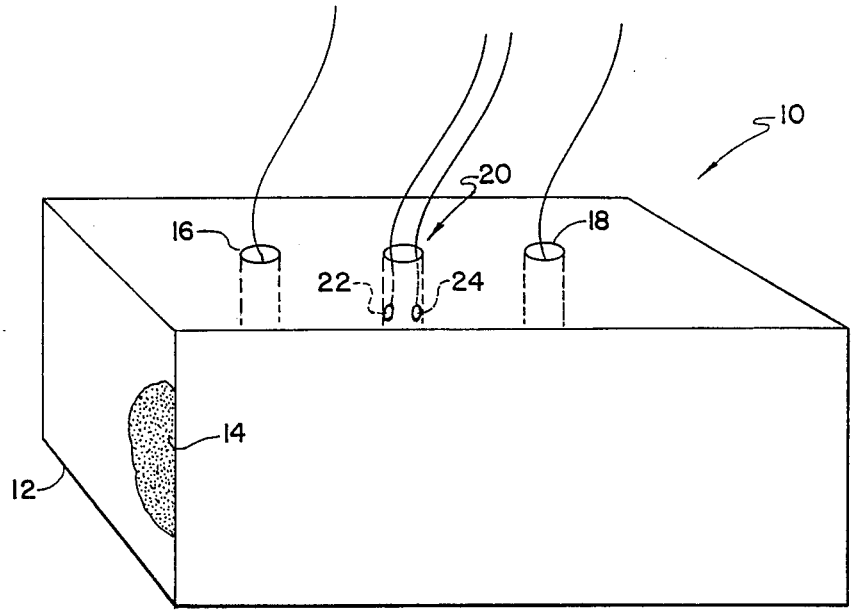
FIG. 1 is an isometric view of a test cell used to determine the thermal response of a simulated oil bearing formation in response to electrical energy input.
Figure 2:
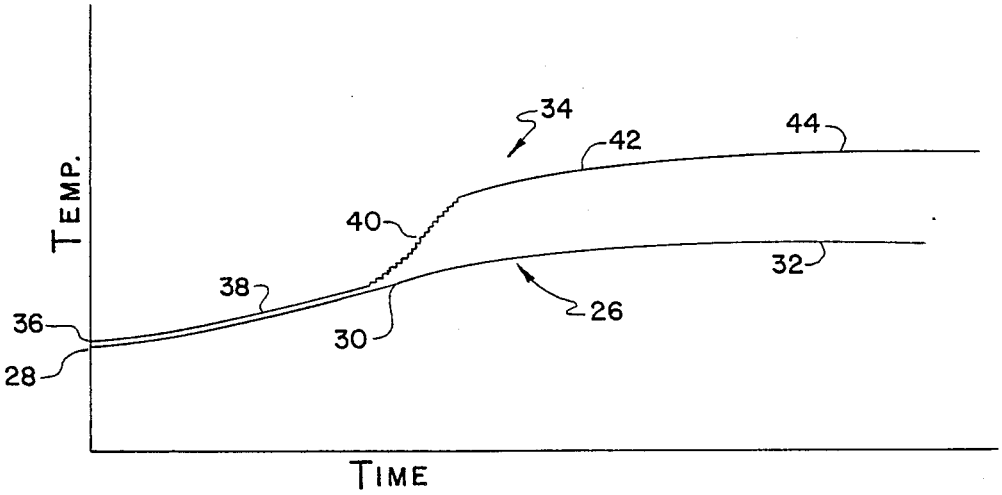
FIG. 2 is a time-temperature chart showing a typical and an atypical formation temperature response to electrical energy input.
Figure 3:
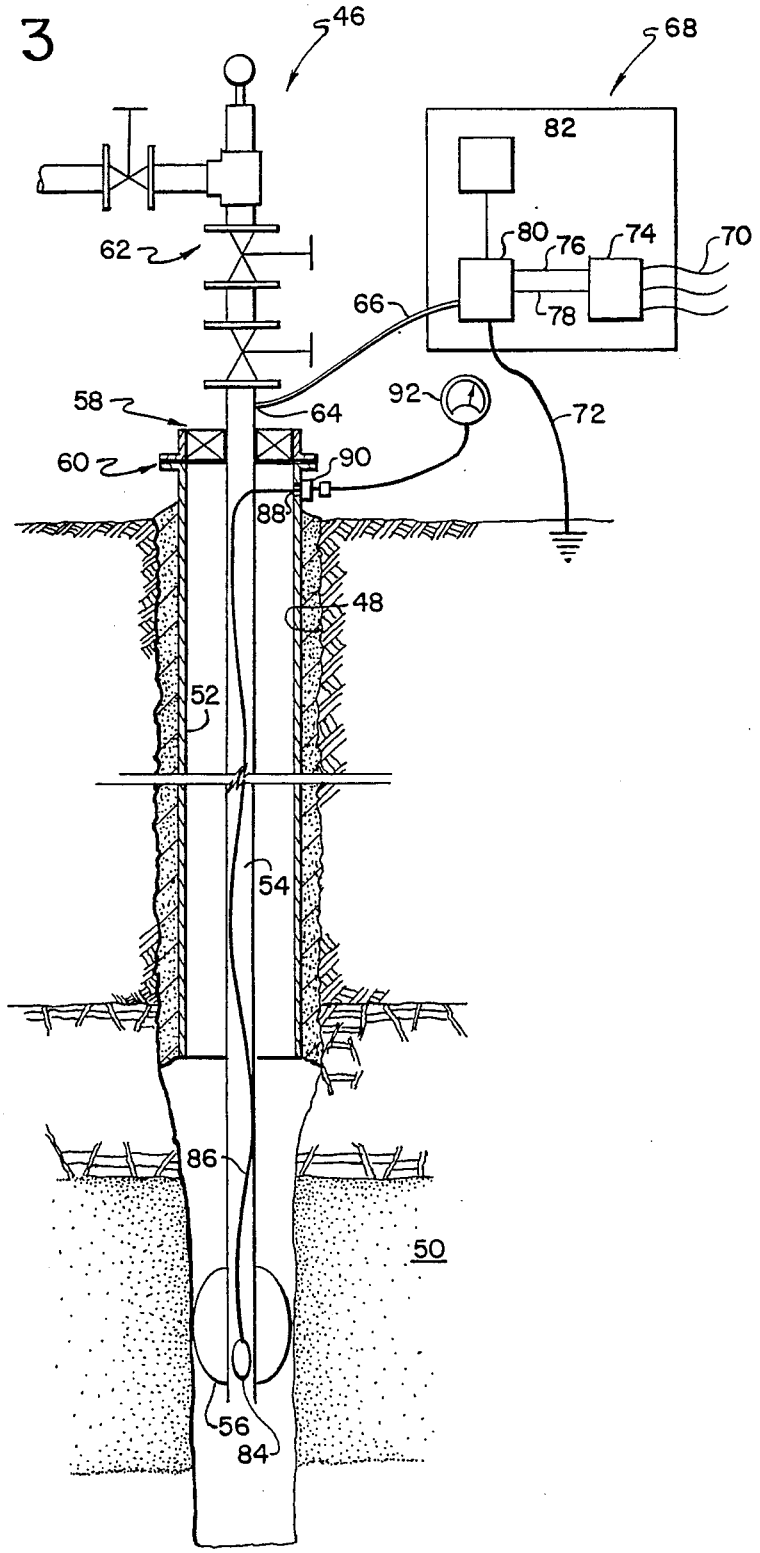
FIG. 3 is a schematic view of a well equipped to deliver alternating current of variable frequency into an oil productive formation.

A string 54 of insulated tubing provides an electrode 56 in electrical communication with the formation 50. The tubing string 54 extends upwardly from the electrode 56 to a tubing hanger 58 supported in and insulated from a well head 60 on the upper end of the casing string 52. The well 46 is illustrated as a flowing well having an insulated, but otherwise conventional tree 62 for delivering produced formation fluids to a separation and storage facility (not shown). Electricity is delivered to the tubing string 54 through a connection 64 and electrical cable 66. Those skilled in the art will recognize the well 46 as a conventional electrically heated well as shown in U.S. Pat. Nos. 3,507,330, 3,547,193, 3,605,888, and 3,642,066.

The current delivered to the cable 66 is some form of alternating current in the sense that it may be of conventional sine wave type, square wave type, pulsed dc, or the like. To this end, there is provided a controller 68 to receive 60 Hz alternating current from a source 70, preferably three phase power lines of an electric utility, and deliver variable frequency alternating current of some description to the outputs 66, 72, the output 72 being grounded in any suitable manner. The controller 68 may be of any suitable type, such as a Model Accutrol 150 commercially available from Westinghouse Electric Corporation. Such controllers 68 are typically organized to include an ac-to-dc converter 74 delivering dc current through a pair of conductors 76, 78 to a chopper 80 which converts the dc current to a series of reversed polarity single phase pulses in the outputs 66, 72. A control mechanism 82 is used to control the chopper 80 and thereby vary the frequency of the alternating current in the outputs 66, 72.

In use, tests are preferably run in the laboratory using the test cell 10 to determine a thermal harmonic frequency of the formation 50 and/or formation contents at existing formation temperature and/or formation pressure. This is done by first determining, either by calculation or by measurement, the thermal response of the test cell 10 to ohmic heating, i.e. in response to constant frequency current. Next, the frequency of the power is changed and applied to the conductors 16, 18, measuring the temperature at the thermocouple 22 and determining the frequency at which the temperature rises at a rate greater than that of ohmic heating. At the well 46, the control mechanism 82 is manipulated to deliver alternating current at the thermal harmonic frequency to the outputs 66, 72 and thereby delivering alternating current at the thermal harmonic frequency to the formation 50.

It is appreciated that the value for a thermal harmonic frequency obtained in the test cell 10 will not always be the same as the thermal harmonic frequency of the formation 50 and/or the contents thereof. Thus, it is preferred that the control mechanism 82 be of a type that will cyclically manipulate the chopper 80 to produce a range or band of frequencies that include the thermal harmonic frequency determined in the laboratory. The Accutrol series of adjustable frequency controllers available from Westinghouse Corporation is capable of accepting programmable controllers which can manipulate the controller 68 to deliver any frequency or frequencies within the capability of the device in substantially any sequence desired. In the event further information is needed, reference is made to the appropriate technical publications of Westinghouse Corporation.

From experience it is presently believed that many, if not most, formations will show a thermal harmonic response, evidenced by the curve 40, at applied frequencies in the range of 12–20 Hz. In a simplified version of this invention, the control mechanism 82 may be manipulated to deliver alternating current in the range of 12–20 Hz, knowing that the thermal harmonic frequency of the formation 50 and/or its contents is within this range and that some harmonic heating will occur.

Another technique that may be used in the field to fine tune the frequency applied from the controller 68 relies on the ability to calculate how much the temperature of the produced formation fluids should rise for a given input of energy. Typical ohmic or resistive heating is in the range of 30% efficient while the combined effect of harmonic and resistive heating is considerably higher. If the formation fluids produced from the tree 62 are substantially hotter than a predicted predetermined value assuming only ohmic heating, it is apparent that harmonic heating is occurring. Thus, if the range of applied frequencies achieves harmonic heating of the produced fluids, the range may be restricted, e.g. divided in half, and heating continued to determine if the harmonic response lies inside or outside the new restricted range. If the temperature of the produced fluids declines, the conclusion is that the harmonic response lies outside the new range and the controller 68 is adjusted accordingly.

Rather than rely on surface temperature measurements, it is preferred to provide a downhole temperature sensor 84 adjacent the bottom of the well. Conveniently, the sensor 84 and its communication wire 86 may be installed in a conventional manner, as by strapping them to the tubing string 54. The upper end of the wire 86 exits through a port 88 in the well head 60. A sealing assembly 90 closes the port 88 and allows the wire 86 to connect to a temperature gauge or recorder 92.

There is another ancillary benefit from the practice of this invention. The standard electrical hookup of electrically heated wells has only two electrical paths, one path down the insulated tubing and one path to ground. Thus, the standard electrical hookup cannot use commercially available three phase power because there are three power lines and no place to hook up the last line. Because electrically heated wells consume a substantial amount of power, some small electric utilities may not allow the operator to take single phase power off the three phase line—this will create an imbalance in the power left on the line and disrupt other customers. Thus, the operator may have to take and pay for three phase power, usually putting two of the lines to ground. Thus, a third of the power purchased in such a situation is wasted. It will be appreciated that the use of the ac-dc-ac converter 74 converts all of the three phase ac input into dc which is in turn chopped into some form of alternating current by the chopper 80. Admitting there are some power losses because of the inefficiencies of the converter 74 and chopper 80, these are minor compared to the gain from using all of the three phase power purchased from the utility comprising the source 70.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

We claim:

1. A method of producing oil from a subterranean formation comprising heating the formation by applying current to the formation and varying the frequency thereof in a range of 12–20 Hz including a harmonic thermal frequency of the formation; and producing oil from the formation.

2. A method of producing oil from a subterranean formation comprising heating the formation by applying current to the formation and varying the frequency thereof in a first range of predetermined frequency band including a harmonic thermal frequency of the formation;

reducing the predetermined frequency band to a second range more restricted than the first range, applying current to the formation and varying the frequency thereof in the second range; and producing oil from the formation.

3. A method of producing oil from a subterranean formation comprising heating the formation by applying current to the formation and varying the frequency thereof in a range including a harmonic thermal frequency of the formation;

measuring the temperatures of the oil;

increasing the frequency of the current in response to increasing temperature of the oil; and producing oil from the formation.

4. A method of producing oil from a subterranean formation comprising determining a value of a harmonic thermal frequency of the formation;

heating the formation by applying current to the formation at the harmonic thermal frequency; and producing oil from the formation.

5. The method of claim 4 further comprising measuring the temperature of the oil and increasing the frequency of the current in response to increasing temperature of the oil.

6. A method of producing oil from a subterranean formation comprising heating the formation by applying current to the formation while varying the frequency thereof in a range of 12–20 Hz; and producing oil from the formation.

7. The method of claim 6 wherein the range of 12–20 Hz includes a harmonic thermal frequency of the formation.

8. The method of claim 6 wherein the heating step comprises delivering electrical current through a well to the formation and the producing step comprises producing oil through the same well from the formation.

9. A method of producing oil from a subterranean formation comprising heating the formation by applying current to the formation and varying the frequency thereof in a range of 12–20 Hz;

reducing the range of 12–20 Hz to a second range more restricted than 12–20 Hz, heating the formation by applying current thereto and varying the frequency thereof in the second range; and producing oil from the formation.

10. The method of claim 9 further comprising measuring the temperature of the oil and increasing the frequency of the current in response to increasing temperature of the oil.

11. A method of producing oil from a subterranean formation through a well extending from the surface to the formation, comprising electrically heating the formation including taking three phase alternating current electrical power from a three wire power line of an electric utility, converting substantially all of the three phase alternating current electrical power into a converted form of alternating current capable of being delivered through a power conductor and a ground conductor, and delivering the converted alternating current through the ground conductor to ground and through the power conductor and the well to the formation; and producing oil from the formation.

* * * * *